US010676297B2

(12) United States Patent
Yoshita

(10) Patent No.: US 10,676,297 B2
(45) Date of Patent: Jun. 9, 2020

(54) MEDIUM TRANSFER DEVICE

(71) Applicant: PFU LIMITED, Ishikawa (JP)

(72) Inventor: Shogo Yoshita, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 16/026,923

(22) Filed: Jul. 3, 2018

(65) Prior Publication Data

US 2019/0291981 A1 Sep. 26, 2019

(30) Foreign Application Priority Data

Mar. 20, 2018 (JP) ..... 2018-051945

(51) Int. Cl.
*B65H 1/02* (2006.01)
*B65H 3/06* (2006.01)
*B65H 9/00* (2006.01)

(52) U.S. Cl.
CPC ..... *B65H 1/025* (2013.01); *B65H 3/0661* (2013.01); *B65H 3/0676* (2013.01); *B65H 9/00* (2013.01)

(58) Field of Classification Search
CPC .... B65H 1/025; B65H 3/0661; B65H 3/0676; B65H 9/00; B65H 9/004; B65H 9/06; B65H 9/08; B65H 9/101
See application file for complete search history.

(56) References Cited

U.S. PATENT DOCUMENTS 6,217,017 B1 * 4/2001 Yamazaki ..... B65H 3/5223 271/121
6,382,621 B1 * 5/2002 Inoue ..... B65H 3/0661 271/120
2005/0104278 A1 * 5/2005 Lin ..... B65H 1/20 271/121
2008/0061494 A1 * 3/2008 Chen ..... B65H 3/0661 271/117
2011/0204562 A1 * 8/2011 Peterson ..... B43M 3/045 271/253
2018/0002124 A1 * 1/2018 Miyauchi ..... B65H 1/025
2018/0305147 A1 * 10/2018 Kuriki ..... B65H 3/0676

FOREIGN PATENT DOCUMENTS

JP 2003-081512 A 3/2003

OTHER PUBLICATIONS

S2060w/S2080w Scanners, available at https://www.kodakalaris.com/en-us/b2b/solutions/document-scanners/ desktop/s2060w-s2080w-scanners (last visit Sep. 29, 2017).

* cited by examiner

*Primary Examiner* — David H Bollinger
(74) *Attorney, Agent, or Firm* — McDermott Will & Emery LLP

(57) ABSTRACT

A medium transfer device includes a swinging member, a hopper in which a setting plate on which a plurality of mediums are placed such that the mediums are moved toward the swinging member by gravitation, and a driving unit configured to swing the swinging member such that the mediums are shaken by the swinging member.

15 Claims, 11 Drawing Sheets

MEDIUM TRANSFER DEVICE

CROSS-REFERENCE TO RELATED APPLICATION

The application is based upon and claims the benefit of priority of the prior Japanese Patent Application No. 2018-051945 filed in Japan on Mar. 20, 2018, the entire contents of which are incorporated herein by reference.

FIELD

The technique of the present disclosure relates to a medium transfer device.

BACKGROUND

Image readers that transfer a plurality of mediums placed on a hopper one by one, and read images on the mediums have been known (refer to Japanese Laid-open Patent Publication No. 2003-81512).

This kind of image readers are enabled to transfer mediums appropriately one by one when the mediums are placed on a hopper with the edges aligned, and to read images on the mediums appropriately. Therefore, users make sure that the edges of the mediums are aligned, and then put the mediums on the hopper. This type of medium transfer device is disadvantageous in that mediums are not appropriately transferred one by one when the mediums are put on the hopper without aligning the edges, and images on the mediums are not appropriately read.

SUMMARY

According to an aspect of an embodiment, a medium transfer device includes a swinging member, a hopper in which a setting plate on which a plurality of mediums are placed such that the mediums are moved toward the swinging member by gravitation, and a driving unit configured to swing the swinging member such that the mediums are shaken by the swinging member.

The object and advantages of the disclosure will be realized and attained by means of the elements and combinations particularly pointed out in the claims.

It is to be understood that both the foregoing general description and the following detailed description are exemplary and explanatory and are not restrictive of the disclosure, as claimed.

DESCRIPTION OF EMBODIMENTS

Figure 1:
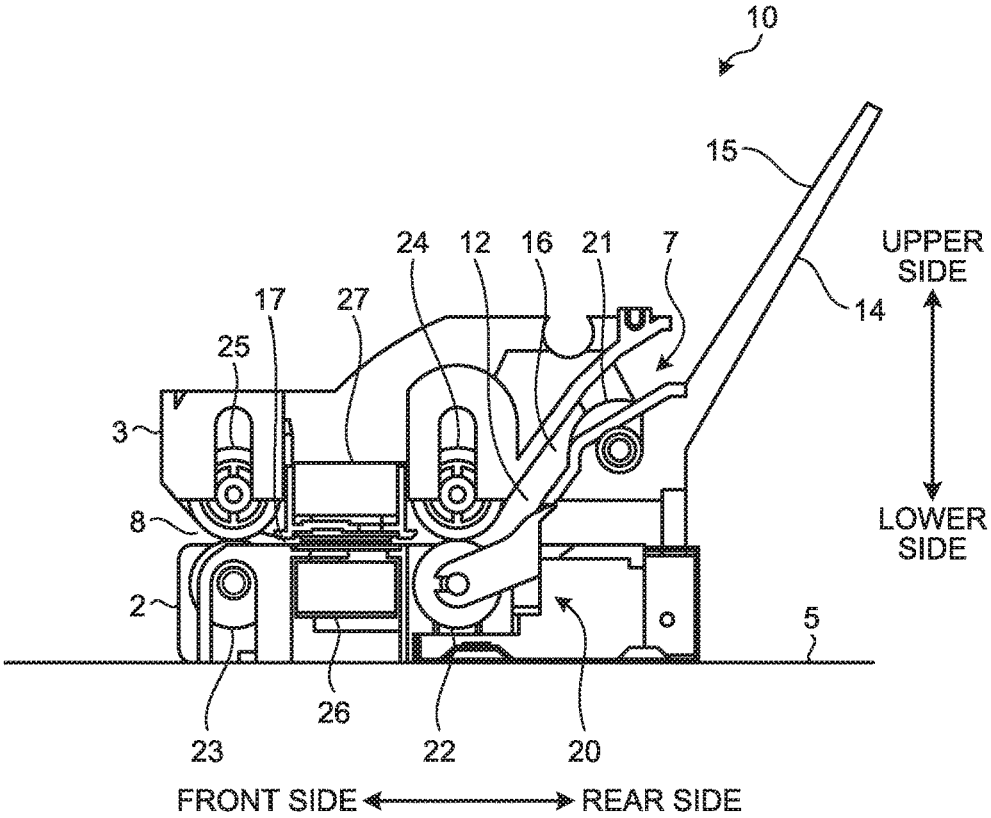
FIG. 1 is a side cross-section of a medium transfer device according to a first embodiment.

Preferred embodiments of the disclosure will be explained with reference to accompanying drawings. A medium transfer device according to embodiments of the present disclosure is explained, referring to the drawings. The following description is not intended to limit the disclosed techniques. In the following description, like reference symbols are assigned to like parts, and duplicated explanation is omitted.

First Embodiment

FIG. 1 is a side cross-section of a medium transfer device 1 according to a first embodiment. The medium transfer device 1 is used for an image reading apparatus 10, and includes a lower frame 2 and an upper frame 3 as illustrated in FIG. 1. The lower frame 2 is mounted on an installation surface 5 facing a side on which the image reading apparatus 10 is installed, and is fixed on the installation surface 5. The upper frame 3 is arranged above the lower frame 2, and is fixed to the lower frame 2.

In the medium transfer device 1, a separation slot 7, a paper ejection slot 8, and a merging point 12 are formed. The separation slot 7 is formed on a rear side of the image reading apparatus 10, and is formed between the lower frame 2 and the upper frame 3. The paper ejection slot 8 is formed on a front side opposite to the rear side on which the separation slot 7 is formed in the image reading apparatus 10, and is formed between the lower frame 2 and the upper frame 3. The paper ejection slot 8 is formed at a lower position that is closer to the installation surface 5 than a position at which the separation slot 7 is formed. The merging point 12 is formed between the lower frame 2 and the upper frame 3. The merging point 12 is formed such that a distance between the installation surface 5 and the merging point 12 is equal to a distance between the installation surface 5 and the paper ejection slot 8.

The medium transfer device 1 further includes a hopper 14. In the hopper 14, a setting plate 15 is formed. The hopper 14 is arranged such that the setting plate 15 faces toward an obliquely upward direction, and that an angle between a plane along the setting plate 15 and a plane along an installation surface 5 is about 55 degrees. The hopper is arranged near the separation slot 7 so that a medium that is set on the setting plate 15 moves toward the separation slot 7 by gravitation. The hopper 14 is rotatably supported by the lower frame 2 so that an angle between the plane along the setting plate 15 and the plane along the installation surface 5 is changeable.

In the medium transfer device 1, a medium-separation transfer path 16 and a medium-scan transfer path 17 are further formed. The medium-separation transfer path 16 is formed between the lower frame 2 and the upper frame 3. The medium-separation transfer path 16 is connected to the separation slot 7 at its one end, and connected to the merging point 12 at the other end, and is arranged to be inclined relative to the plane along the installation surface such that the end connected to the merging point 12 is positioned lower than the end connected to the separation slot 7. The medium-scan transfer path 17 is formed between the lower frame 2 and the upper frame 3. The medium-scan transfer path 17 is connected to the merging point 12 at its one end and connected to the paper ejection slot 8 at the other end, and is formed along a plane that is parallel to the plane along the installation surface 5.

The medium transfer device 1 further includes a transfer unit 20. The transfer unit 20 includes a separating unit 21, a first feed roller 22, a second feed roller 23, a first pressure roller 24, and a second pressure roller 25. The separating unit 21 is formed at a halfway portion of the medium-separation transfer path 16. The separating unit 21 separates one medium that is in contact with the setting plate 15 of the hopper 14 from mediums that are inserted to the medium-separation transfer path 16 from the separation slot 7, and transfers the separated one medium from the separation slot 7 to the merging point 12 through the medium-separation transfer path 16.

The first feed roller 22 is arranged below the medium-scan transfer path 17, and is rotatably supported by the lower frame 2. The first feed roller 22 transfers a medium that is positioned in the medium-scan transfer path 17 from the merging point 12 to the paper ejection slot 8 by rotating in a forward direction (counterclockwise direction in FIG. 1). The second feed roller 23 is arranged between the first feed roller 22 and the paper ejection slop 8 below the medium-scan transfer path 17, and is rotatably supported by the lower frame 2. The second feed roller 23 transfers a medium that is positioned in the medium-scan transfer path 17 from the merging point 12 to the paper ejection slot 8 by rotating in a forward direction (counterclockwise direction in FIG. 1).

The first pressure roller 24 is formed in a cylindrical shape. The first pressure roller 24 is arranged above the medium-scan transfer path 17, and is arranged above the first feed roller 22. The first pressure roller 24 is supported so as to enable translation in a vertical direction that is perpendicular to the plane along the installation surface 5, and to enable rotation by the upper frame 3. The second pressure roller 25 transfers a medium that is positioned in the medium-scan transfer path 17 from the merging point 12 to the paper ejection slot 8 by pressing the medium that is positioned in the medium-scan transfer path 17 to the second feed roller, and by rotating in a forward direction (counterclockwise direction in FIG. 1).

The second feed roller 23 is formed in a cylindrical shape. The second feed roller 23 is arranged between the first feed roller 22 and the paper ejection slot 8 below the medium-scan transfer path 17, and is rotatably supported by the lower frame 2. The second feed roller 23 transfers a medium in the medium-scan transfer path 17 from the merging point 12 to the paper ejection slot 8 by rotating in a forward direction (counterclockwise direction in FIG. 1).

The second pressure roller 25 is formed in a cylindrical shape. The second pressure roller 25 is arranged at an upper portion of the medium-scan transfer path 17 and above the second feed roller 23. The second pressure roller is supported by the upper frame 3 so as to enable translation in a vertical direction and rotation. The second pressure roller 25 presses a medium that is positioned in the medium-scan transfer path 17 to the second feed roller 23, and transfers the medium in the medium-scan transfer path 17 from the merging point 12 to the paper ejection slot 8 by rotating in a forward direction (clockwise direction in FIG. 1).

The image reading apparatus 10 further includes a lower reading unit 26 and an upper reading unit 27. The lower reading unit 26 is arranged at a lower side of the medium-scan transfer path 17, and is arranged between the first feed roller 22 and the second feed roller 23. The lower reading unit 26 reads an image on a lower surface of a medium that is transferred in the medium-scan transfer path 17. The upper reading unit 27 is arranged above the lower reading unit 26 on an upper side of the medium-scan transfer path 17, and is arranged between the first pressure roller 24 and the second pressure roller 25. The upper reading unit 27 reads an image on an upper surface of the medium that is transferred in the medium-scan transfer path 17.

Figure 2:
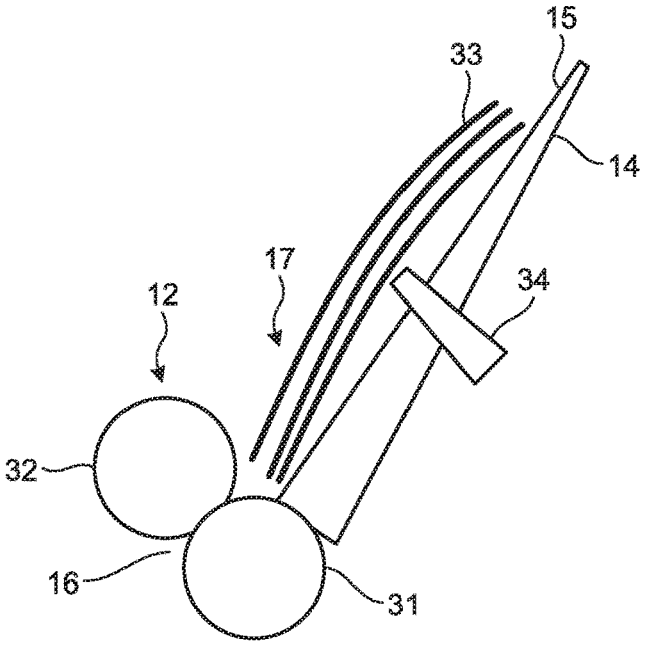
FIG. 2 is a cross-section illustrating a separating unit and a hopper.

FIG. 2 is a cross-section illustrating the separating unit 21 and the hopper 14. The separating unit 21 includes a pick roller 31 and a brake roller 32 as illustrated in FIG. 2. The pick roller 31 is arranged on a lower side of the medium-separation transfer path 16, and is rotatably supported by the lower frame 2. The pick roller 31 transfers a medium that is in contact with the setting plate 15 of the hopper 14 out of mediums 33 inserted to the medium-separation transfer path 16 from the separation slot 7 toward the merging point 12 by rotating in a forward direction (counterclockwise direction in FIG. 2). Each of the mediums 33 is, for example, a sheet of paper, and the mediums 33 are not bound together and can be separated from each other.

The brake roller 32 is arranged on an upper side of the medium-separation transfer path 16, and above the pick roller 31 so as to be in contact with the pick roller 31, and is rotatably supported by the upper frame 3. The brake roller 32 collaterally rotates in a forward direction (clockwise direction in FIG. 2) following rotation of the pick roller 31 when the pick roller 31 is rotating in the forward direction and when a medium is not present between the pick roller 31 and the brake roller 32. The brake roller transfers a medium that is in contact with the brake roller 32 out of the mediums 33 by rotating in a reverse direction (counterclockwise direction in FIG. 2) toward the hopper 14 when the mediums 33 are present between the pick roller 31 and the brake roller 32. The brake roller 32 collaterally rotates in the forward direction when the brake roller 32 is in contact with one medium that is being transferred toward the merging point 12 by the pick roller 31, following the transfer of the medium.

The hopper 14 has a protrusion 34. The protrusion 34 is arranged substantially at the center of the hopper 14, and is formed such that the mediums 33 come into contact with the protrusion 34, protruding out from the setting plate 15. The protrusion 34 is supported by the hopper 14 so as to enable translation in a parallel direction to the normal along the setting plate 15.

Figure 3:
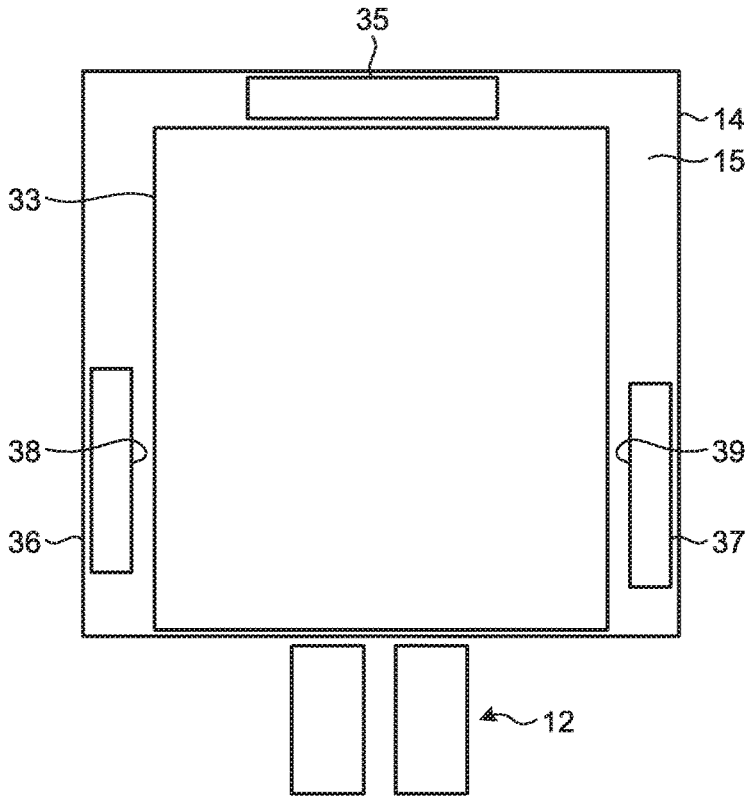
FIG. 3 is a plan view of the hopper.

FIG. 3 is a plan view of the hopper 14. The hopper 14 includes a stopper 35, a left side guide 36, and a right side guide 37 as illustrated in FIG. 3. The stopper 35 is arranged at an end of the hopper 14 on a far side from the separating unit 21 so that the mediums 33 are arranged between the separating unit 21 and the stopper 35, and is fixed to the hopper 14 so as to stick out from the setting plate 15. In the left side guide 36, a left guide surface 38 is formed. In the right side guide 37, a right guide surface is formed. The left side guide 36 and the right side guide 37 are arranged at respective sides so that the mediums 33 are placed between the left side guide 36 and the right side guide 37 and that the left guide surface 38 and the right guide surface 39 face each other. The left side guide 36 is movably supported by the hopper 14 to stick out from the setting plate 15 such that a plane along the left guide surface 38 is perpendicular to a plane along the setting plate 15, the left guide surface 38. The right side guide 37 is movably supported by the hopper 14 to stick out from the setting plate 15 such that a plane along the right guide surface 39 is perpendicular to the plane along the setting plate 15, the left guide surface 38.

Figure 4:
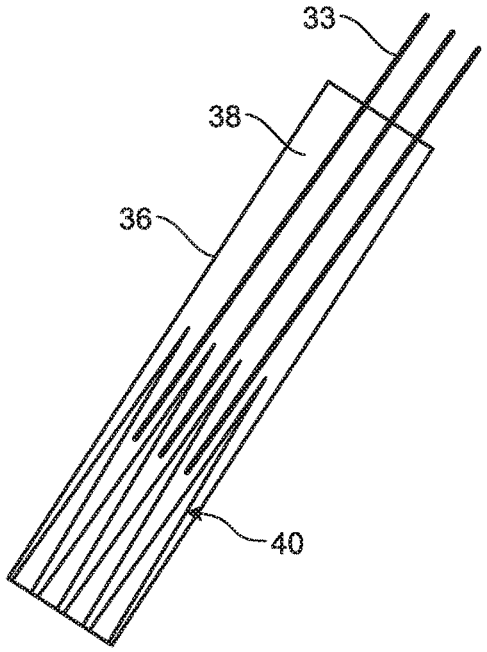
FIG. 4 is a side view of a left side guide.

FIG. 4 is a side view of the left side guide 36. In the left side guide 36, a plurality of left side-guide ribs 40 are formed as illustrated in FIG. 4. The left side-guide ribs 40 are formed to protrude out from the left guide surface 38 so that the mediums 33 placed on the hopper 14 enter gaps therebetween. In the right side guide 37, similarly to the left side guide 36, a plurality of right side-guide ribs that protrude from the right guide surface 39 are formed.

Figure 5:
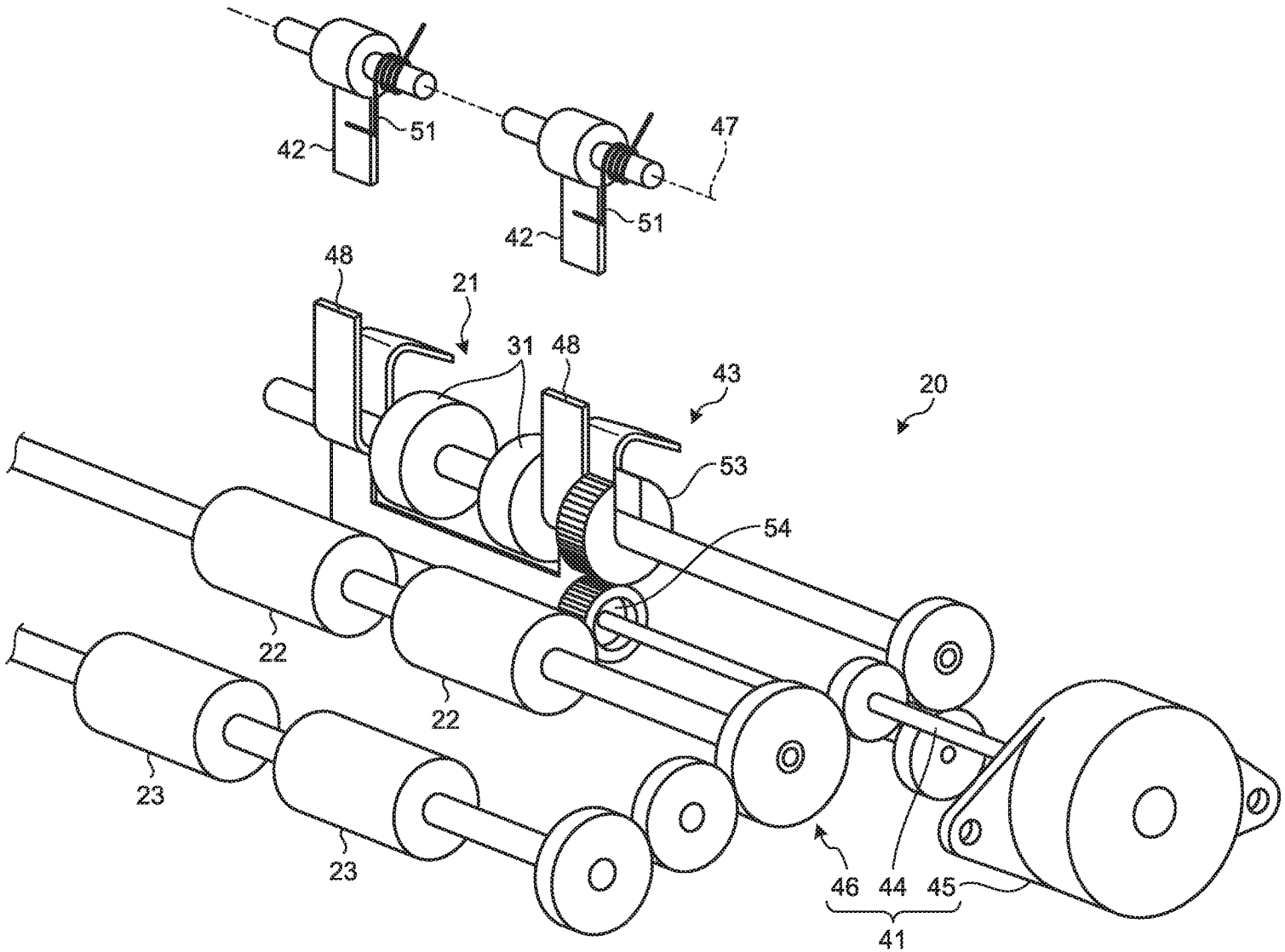
FIG. 5 is an exploded perspective view of a transfer unit.

FIG. 5 is an exploded perspective view of the transfer unit 20. The transfer unit 20 includes a roller driving unit 41, flaps 42, and a flap driving unit 43 as illustrated in FIG. 5. The roller driving unit 41 includes a driving axis 44, a motor 45, and a rotation transfer mechanism 46. The driving axis 44 is formed in a rod shape, and is rotatably supported by the lower frame 2. The motor 45 is supported by the lower frame 2, and makes the driving axis 44 rotate in a forward direction and a reverse direction. The rotation transfer mechanism 46 is formed with a gear train, and transfers rotation of the driving axis 44 to the first feed roller 22, the second feed roller 23, and the pick roller 31. That is, the rotation transfer mechanism 46 causes the first feed roller 22, the second feed roller 23, and the pick roller 31 to rotate in the forward direction when the driving axis 44 rotates in the forward direction. The rotation transfer mechanism 46 also causes the first feed roller 22, the second feed roller 23, and the pick roller 31 to rotate in the reverse direction when the driving axis 44 rotates in a reverse direction.

The flap 42 is formed in a belt shape. The flap 42 is supported by the upper frame 3 rotatably about a rotation axis 47 so as to be arranged in a contact area or a retraction area. The rotation axis 47 is arranged parallel to a rotation axis of the rotation of the pick roller 31 and above the pick roller 31.

The flap driving unit 43 includes a twist coil spring 51, a set guide 52, and a set-guide driving unit 53, and a torque limiter unit 54. The twist coil spring 51 applies an elastic force to the flap 42 so that the flap 42 is arranged at a flap initial position in the contact area. The set guide 52 is supported by the lower frame 2 rotatably about a rotation axis same as the rotation axis of the rotation of the pick roller 31 so as to be arranged in a hold area or a release area. The set-guide driving unit 53 is formed with a gear train, and transfers rotation of the driving axis 44 to the set guide 52. That is, the set-guide driving unit 53 causes the set guide 52 to rotate in a forward direction when the driving axis 44 rotates in a forward direction, and causes the set guide 52 to rotate in a reverse direction when the driving axis 44 rotates in a reverse direction. The torque limiter unit 54 shields rotation of the driving axis 44 to be transferred to the set guide 52 when an absolute value of torque to be transmitted to the set guide 52 from the driving axis 44 exceeds a predetermined value.

Figure 6:
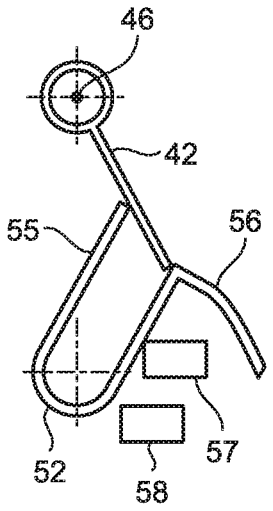
FIG. 6 is a side view of a flap and a flap driving unit when a set guide is positioned at a reverse-rotation stopper-abutting position in a hold area.

FIG. 6 is a side view of the flap 42 and the flap driving unit 43 when the set guide 52 is positioned at the reverse-rotation stopper-abutting position in the hold area. In the set guide 52, a holding portion 55 and a curved-out portion 56 are formed as illustrated in FIG. 6. The holding portion 55 is formed to close in on the flap 42 to hold it when the set guide 52 is positioned in the hold area. The flap 42 is positioned in the contact area by being held by the set guide 52 when the set guide 52 is positioned in the hold area. The flap 42 abuts on the mediums inserted to the medium-separation transfer path 16 from the separation slot 7 when positioned in the contact area, to prevent the mediums from being contact with the pick roller 31 and the brake roller 32. The curved-out portion 56 is formed to project from the holding portion 55, and is fixed to the holding portion 55. The curved-out portion 56 prevents the mediums inserted to the medium-separation transfer path 16 from the separation slot 7 from being contact with the pick roller 31 when the set guide 52 is positioned in the hold area.

The flap driving unit 43 includes a reverse rotation stopper 57 and a forward rotation stopper 58. The reverse rotation stopper 57 is arranged to abut on the set guide 52 when the set guide 52 is positioned at the reverse-rotation stopper-abutting position, and is fixed to the lower frame 2. The reverse rotation stopper 57 limits a movable range of the set guide 52 when the reverse rotation stopper is positioned at the reverse-rotation stopper-abutting position, that is, when abutting on the set guide 52, to prevent reverse rotation (clockwise direction in FIG. 6) of the set guide 52.

Figure 7:
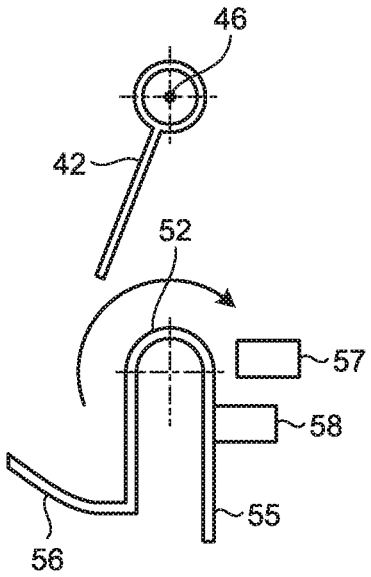
FIG. 7 is a side view of the flap and the flap driving unit when the set guide is positioned at a forward-rotation stopper-abutting position in a release area.

FIG. 7 is a side view of the flap 42 and the flap driving unit 43 when the set guide 52 is positioned at the forward-rotation stopper-abutting position in the release area. The forward rotation stopper 58 is arranged to abut on the set guide 52 as illustrated in FIG. 7 when the set guide is positioned at the forward-rotation stopper-abutting position in the release area, and is fixed to the lower frame 2. The forward rotation stopper 58 limits the movable range of the set guide 52 when the set guide 52 is positioned at the forward-rotation stopper-abutting position, that is, when abutting on the set guide 52, to prevent forward rotation (counterclockwise direction in FIG. 7) of the set guide 52.

The flap 42 is released from the set guide 52 when the set guide 52 is positioned in the release area, and can be arranged in the retraction area that is different from the contact area. The flap 42 can be retracted from the mediums to allow the mediums that are inserted from the medium-separation transfer path 16 from the separation slot 7 to be contact with the pick roller 31 and the brake roller 32.

Figure 8:
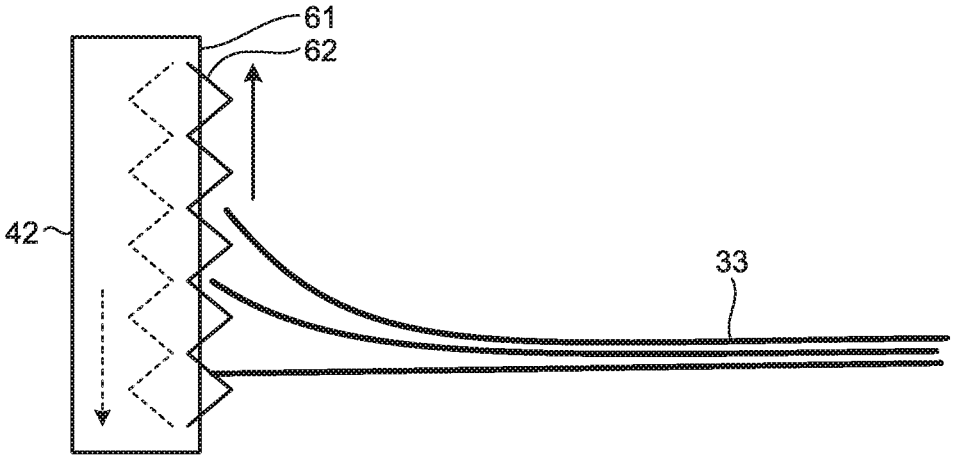
FIG. 8 is a side view of the flap.

FIG. 8 is a side view of the flap 42. The flap 42 has projections and depressions 62 formed on a separation-slot-side surface 61 that faces toward the separation slot 7 as illustrated in FIG. 8. The projections and depressions 62 are formed to enter gaps of the mediums 33 when the mediums 33 placed on the hopper 14 abut on the separation-slot-side surface 61.

Figure 9:
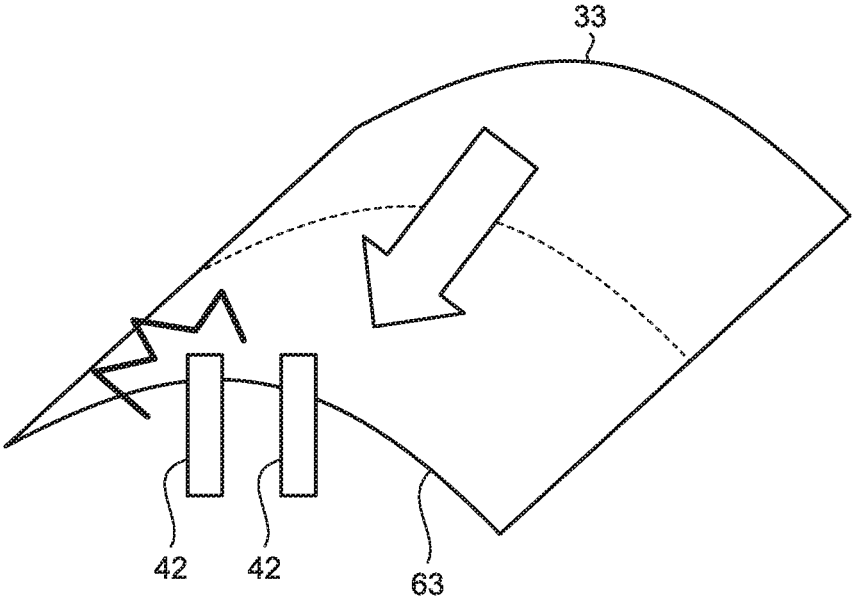
FIG. 9 is a perspective view of a plurality of mediums that are placed on the hopper.

FIG. 9 is a perspective view of the mediums 33 that are placed on the hopper 14. The setting plate 15 of the hopper 14 is bent to fit a curved surface. Because the setting plate 15 is bent, edges of the mediums 33 placed on the hopper 14 that are in contact with the flaps 42 positioned in the contact area are bent as illustrated in FIG. 9, and the edges abutting on the flaps 42 fit a curved line.

Figure 10:
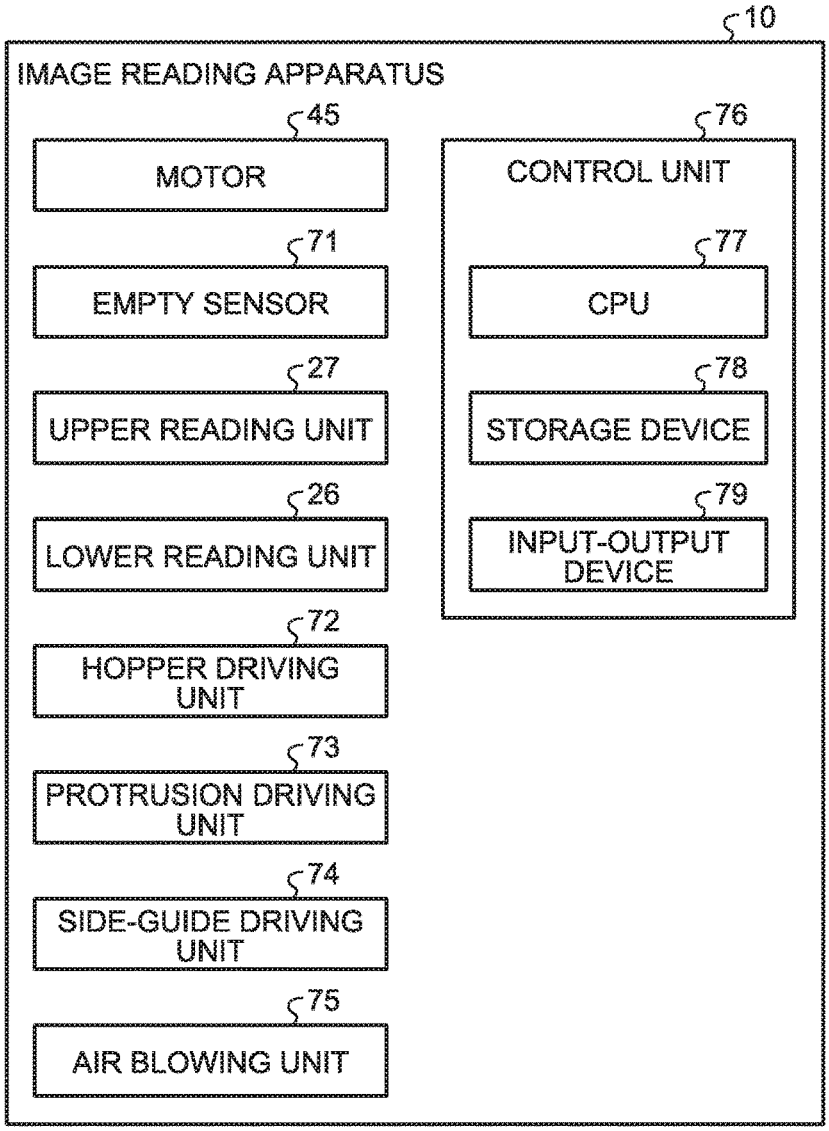
FIG. 10 is a block diagram of an image reading apparatus.

FIG. 10 is a block diagram of the image reading apparatus 10. The image reading apparatus 10 further includes an empty sensor 71, a hopper driving unit 72, a protrusion driving unit 73, a side-guide driving unit 74, an air blowing unit 75, and a control unit 76. The empty sensor 71 is controlled by the control unit 76 to detect whether a medium is set on the hopper 14. The hopper driving unit 72 includes an actuator, and is controlled by the control unit to move the hopper 14. The protrusion driving unit 73 includes an actuator, and is controlled by the control unit 76 to move the protrusion 34. The side-guide driving unit 74 includes an actuator, and is controlled by the control unit 76 to move the left side guide 36 and the right side guide 37. The air blowing unit 75 includes a blower, and is controlled by the control unit 76 to blow air on an end surface of the mediums placed on the hopper 14.

The control unit 76 is a computer, and includes a central processing unit (CPU) 77, a storage device 78, and an input-output device 79 as illustrated in FIG. 10. The CPU 77 process information by executing a computer program that is installed in the control unit 76, and controls the storage device 78 and the input-output device 79. The storage device 78 stores the computer program and information that is used by the CPU 77. As the storage device 78, for example, a memory such as a random-access memory (RAM) and a read-only memory (ROM), a fixed disk such as a hard disk, a solid state drive (SSD), or an optical disk can be used. The input-output device 79 includes a scan button, outputs information that is generated by operation by a user to the CPU 77, and outputs information generated by the CPU 77 in a user recognizable manner. For example, the input-output device 79 includes a scan button, detects whether the scan button is pressed, and outputs the detection result to the CPU 77.

The control unit 76 further controls the motor 45, the empty sensor 71, the lower reading unit 26, the upper reading unit 27, the hopper driving unit 72, the protrusion driving unit 73, the side-guide driving unit 74, and the air blowing unit 75. Specifically, the control unit 76 controls the empty sensor 71 to detect whether a medium is set on the hopper 14. The control unit 76 controls the motor 45 such that the driving axis 44 rotates in the forward direction, or driving axis 44 to rotate in the reverse direction. The control unit 76 controls the lower reading unit 26 and the upper reading unit 27 so that images on both sides of a medium being transferred in the medium-scan transfer path 17 are read. The control unit 76 controls the hopper driving unit 72 such that a degree of inclination of the setting plate 15 of the hopper 14 varies, or that the hopper 14 swings. The control unit 76 controls the protrusion driving unit 73 such that the protrusion 34 reciprocates. The control unit 76 controls the side-guide driving unit 74 such that the left side guide 36 and the right side guide 37 swing. The control unit 76 controls the air blowing unit 75 such that air is blown on an end surface of mediums set on the hopper 14.

Action of Image Reading Apparatus 10 According to First Embodiment

A user presses the scan button after setting mediums on the hopper 14 when wishing to have images on the mediums read by the image reading apparatus 10. When set on the hopper 14, the mediums are inserted to the medium-separation transfer path 16 from the separation slot 7 by gravitation, and abut on the flap 42.

The image reading apparatus 10 performs an action of swinging the flap 42 and an action of reading an image on a medium. The action of swinging the flap 42 is performed when the flap 42 is positioned at the initial position, that is, when the set guide 52 is positioned at a set-guide initial position. The control unit 76 controls the empty sensor 71 to detect whether a medium is set on the hopper 14 when the flap 42 is positioned at the flap initial position.

The control unit 76 controls the hopper driving unit 72 to move the hopper 14 such that the inclination of the hopper 14 is steep when it is detected that a medium is set on the hopper 14. The image reading apparatus 10 can increase a force of moving mediums set on the hopper 14 toward the flap 42 by gravitation, and ensure that the mediums abut on the flap 42. The control unit 76 further controls the motor 45 to swing the flap 42 in the contact area for a predetermined period when it is detected that a medium is set on the hopper 14.

Figure 11:
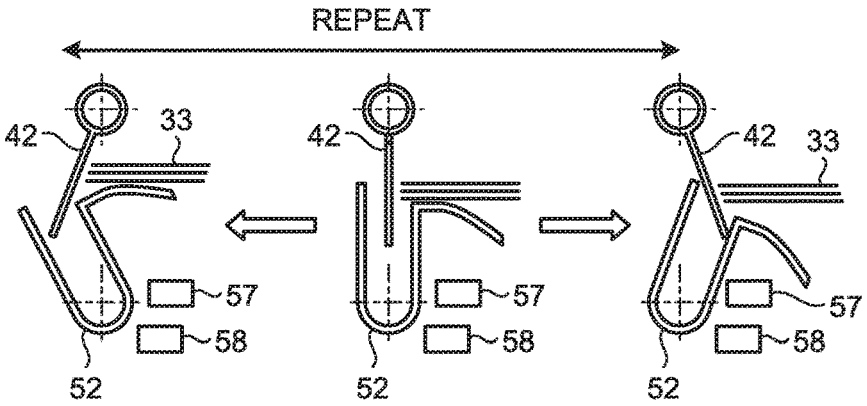
FIG. 11 is a state transition diagram for explaining an operation of swinging the flap.

FIG. 11 is a state transition diagram for explaining an operation of swinging the flap 42. The control unit 76 first controls the motor 45 to cause the driving axis to make reverse rotation for as many times as a predetermined number of steps when it is detected that a medium is set on the hopper 14. When the driving axis 44 makes reverse rotation as many times as the predetermined number of steps, the set guide 52 is positioned at the reverse-rotation stopper-abutting position by the reverse rotation to abut on the reverse rotation stopper 57. At this time, when the driving axis 44 further rotates in the reverse direction after the set guide 52 abuts on the reverse rotation stopper 57, the torque limiter unit 54 stops the rotation from being transferred to the set guide 52, and the set guide 54 thereby maintains to be held at the reverse-rotation stopper-abutting position. The flap 42 is positioned at an end closer to the separation slot 7 in the contact area when the set guide 52 is positioned at the reverse-rotation stopper-abutting position. The control unit 76 controls, when the driving axis 44 rotates in the reverse direction for a predetermined number of steps, the motor 45 to cause the driving axis 44 to rotate in the forward direction as much as the predetermined number of steps. The set guide 52 is rotated in the forward direction along with the rotation of the driving axis in the forward direction for the predetermined number of steps, to be positioned at an end closer to the release area in the hold area. The flap 42 is positioned at an end on a far side from the separation slot in the contact area when the set guide 52 is positioned at an end closer to the release area in the hold area. The control unit 76 repeats reverse rotation and forward rotation of the driving axis 44 alternately in a predetermined period. The flap 42 swings for the predetermined period by the reverse rotation and the forward rotation of the driving axis 44 alternately repeated in the predetermined time.

By swinging the flap 42, the image reading apparatus 10 can shake mediums that are abut on the flap 42. The image reading apparatus 10 shakes the mediums abut on the flap 42, thereby aligning edges abutting on the flap 42 of the mediums appropriately.

The control unit 76 further controls the hopper driving unit 72 to swing the hopper 14 in the predetermined period when it is detected that a medium is set on the hopper 14. The image reading apparatus 10 can shake mediums set on the hopper 14 further by swinging the hopper 14. The image reading apparatus 10 can align edges of the mediums more appropriately by shaking the mediums by swinging the hopper 14.

The control unit 76 further controls the protrusion driving unit 73 to reciprocate the protrusion 34 in the predetermined period when it is detected that a medium is set on the hopper 14. The image reading apparatus 10 can shake mediums set on the hopper 14 further by reciprocating the protrusion 34. The image reading apparatus 10 can align edges of the mediums more appropriately by shaking the mediums by reciprocating the protrusion 34.

The control unit 76 further controls the side-guide driving unit 74 to shake the left side guide 36 and the right side guide 37 in the predetermined period when it is detected that a medium is set on the hopper 14. The image reading apparatus 10 can shake mediums set on the hopper 14 further surely by shaking the left side guide 36 and the right side guide 37. The image reading apparatus 10 can align edges of the mediums more appropriately by shaking the mediums by shaking the left side guide 36 and the right side guide 37.

The control unit 76 further controls the air blowing unit 75 to blow air on the edges of the mediums set on the hopper 14. When air is blown on the edges, air enters gaps between the mediums, and thus reducing frictional forces that act against movement of the mediums. Therefore, the image reading apparatus 10 can align the edges of the mediums appropriately by shaking by blowing air on the edges of the mediums by gravitation.

The image reading apparatus 10 enables to facilitate entrance of air into gaps between the mediums with the projections and depressions 62 formed in the flap 42 so that the projections and depressions 62 enter gaps between the mediums when the flap 42 is swinging. The image reading apparatus 10 has the left side-guide ribs 40 formed on the left side guide 36. The left side-guide ribs 40 thus enter gaps between the mediums and facilitate entrance of air into the gaps between the mediums. The image reading apparatus 10 has the right side-guide ribs formed on the right side guide 37. The right side-guide ribs thus enter gaps between the mediums and facilitate entrance of air into the gaps between the mediums. The image reading apparatus 10 facilitates entrance of air into gaps between the mediums, and to reduce the frictional forces on the mediums by air entering the gaps between the mediums, thereby aligning edges of the mediums appropriately. A user can align edges of mediums easily.

Figure 12:
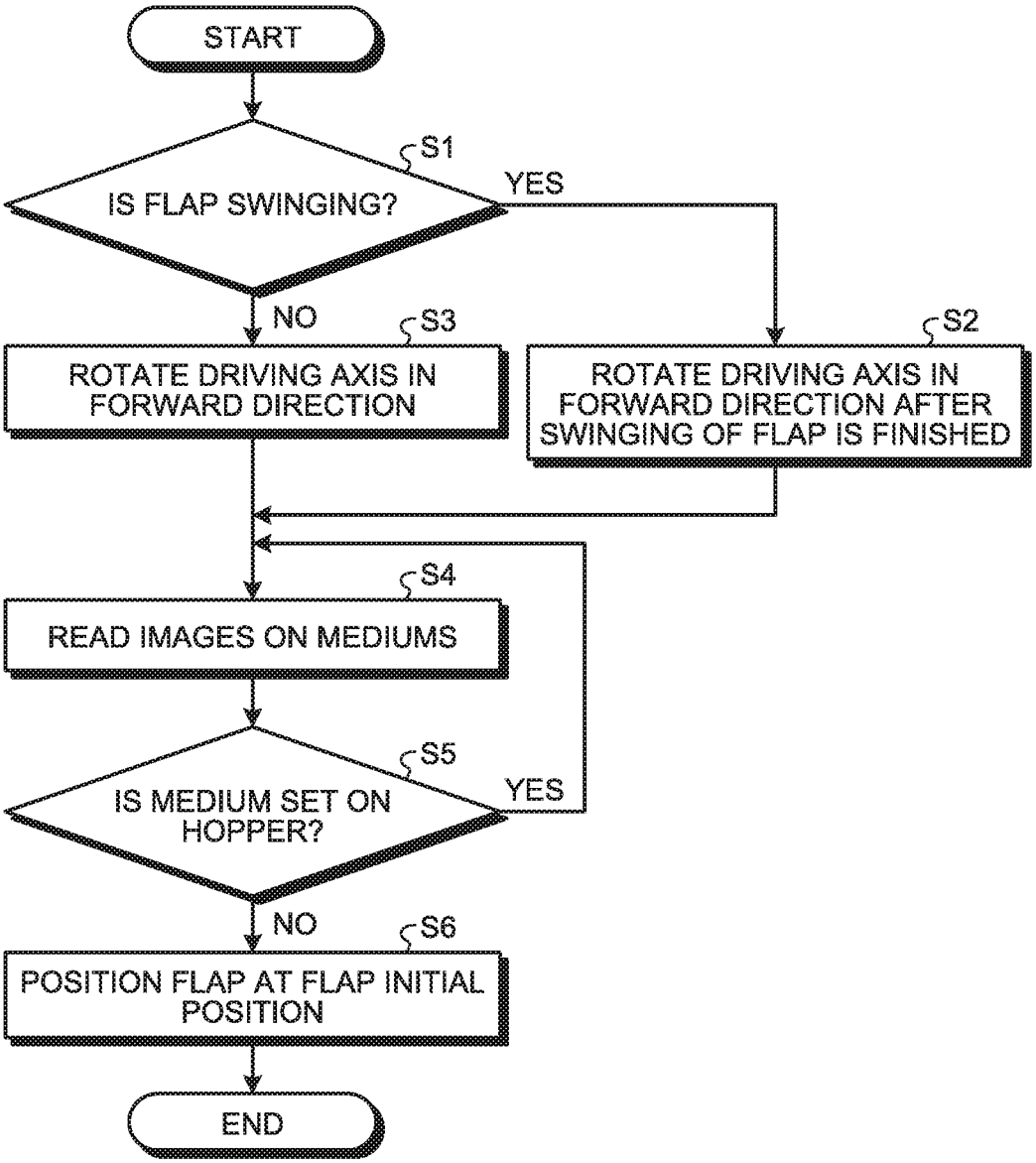
FIG. 12 is a flowchart for explaining an operation of the image reading apparatus reading an image on a medium.

FIG. 12 is a flowchart for explaining an operation of the image reading apparatus 10 reading an image on a medium. The control unit 76 controls the input-output device 79 to detect whether the scan button is pressed. When it is detected that the scan button is pressed, the control unit 76 determines whether an operation of swinging the flap 42 is being performed (step S1). When the flap 42 is swinging (step S1: YES), the control unit 76 controls the motor 45 after the operation of swinging the flap 42 is finished, to rotate the driving axis 44 in the forward direction (step S2). When the flap 42 is not swinging (step S1: NO), the control unit 76 controls the motor 45 right after the scan button is pressed, to rotate the driving axis 44 in the forward direction (step S3).

Figure 13:
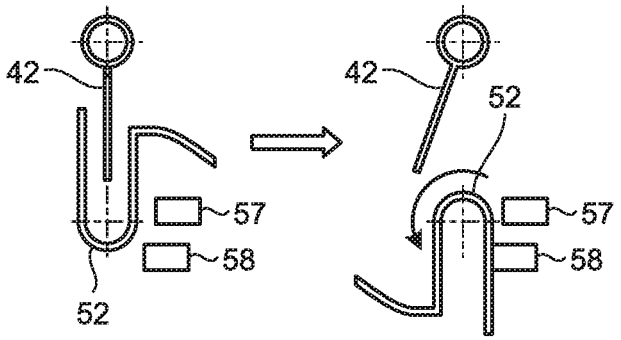
FIG. 13 is a state transition diagram for explaining an action of the flap when a driving axis is rotated in a forward direction.

FIG. 13 is a state transition diagram for explaining an action of the flap 42 when the driving axis 44 is rotated in a forward rotation. The set guide 52 is positioned at the set-guide initial position in the hold area before the operation of reading an image on a medium is started as illustrated in FIG. 13. The flap 42 is positioned at the flap initial position when the set guide 52 is positioned at the set-guide initial position. The set guide 52 rotates in the forward direction along with forward rotation of the driving axis 44, to be positioned in the release area, and is positioned at the forward-rotation stopper-abutting position in the release area. When positioned at the forward-rotation stopper-abutting position, the set guide 52 abuts on the forward rotation stopper 58, and is thus restricted forward rotation, to be kept at the forward-rotation stopper-abutting position. The flap 42 is released to be positioned at the retraction area when the set guide 52 is positioned in the release area.

The mediums inserted to the medium-separation transfer path 16 from the separation slot 7 move toward the merging point 12 in the medium-separation transfer path 16 by gravitation when the set guide 52 is positioned in the release area, to move the flap 42 to the retraction area. The mediums move further toward the merging point 12 in the medium-separation transfer path 16 by gravitation after the flap 42 is positioned in the retraction area to be provided to the separating unit 21.

The separating unit 21 separates one medium that is in contact with the setting plate 15 out of the mediums set on the hopper 14 from the mediums as the driving axis 44 rotates in the forward direction. Furthermore, the separating unit 21 transfers the separated one medium from the separation slot 7 toward the merging point 12 through the medium-separation transfer path 16 by the forward rotation of the driving axis 44. The medium that is transferred from the separation slot 7 toward the merging point 12 by the separating unit 21 is transferred to the medium-scan transfer path 17, and is sandwiched between the first feed roller 22 and the first pressure roller 24.

The first pressure roller 24 presses, when one medium is brought to be sandwiched between the first feed roller 22 and the first pressure roller 24, the sandwiched medium to the first feed roller 22. The first feed roller 22 rotates in the forward direction as the driving axis 44 rotates in the forward direction. The first feed roller 22 transfers the one medium that is pressed to the first feed roller 22 by the first pressure roller 24 to the paper ejection slot 8 through the medium-scan transfer path 17 by rotating in the forward direction.

The one medium that is transferred toward the paper ejection slot 8 by the first feed roller 22 in the medium-scan transfer path 17 is transferred between the lower reading unit 26 and the upper reading unit 27. The control unit 76 controls the lower reading unit 26 and the upper reading unit 27 to read images on both sides of the medium (step S4). The one medium transferred toward the paper ejection slot 8 by the first feed roller 22 is sandwiched between the second feed roller 23 and the second pressure roller 25 after passing through between the lower reading unit 26 and the upper reading unit 27.

The second pressure roller 25 presses, when the one medium is brought to be sandwiched between the second feed roller 23 and the second pressure roller 25, the sandwiched medium to the second feed roller 23. The second feed roller 23 is rotating in the forward direction as the driving axis is rotating in the forward direction. The second feed roller 23 transfers the medium sandwiched between the second feed roller 23 and the second pressure roller 25 toward the paper ejection slot 8 through the medium-scan transfer path 17 by rotation in the forward direction, to eject the medium from the paper ejection slot 8.

When it is detected that a medium is set on the hopper 14 (step S5: YES), the control unit 76 repeatedly perform the processing at step S3 as many times as the number of the mediums, and reads images on both sides of all of the mediums.

When it is detected that a medium is not set on the hopper 14 (step S5) NO), the control unit 76 controls the motor 45 after all of the mediums are ejected through the paper ejection slot 8, to position the flap 42 at the initial position (step S6).

Figure 14:
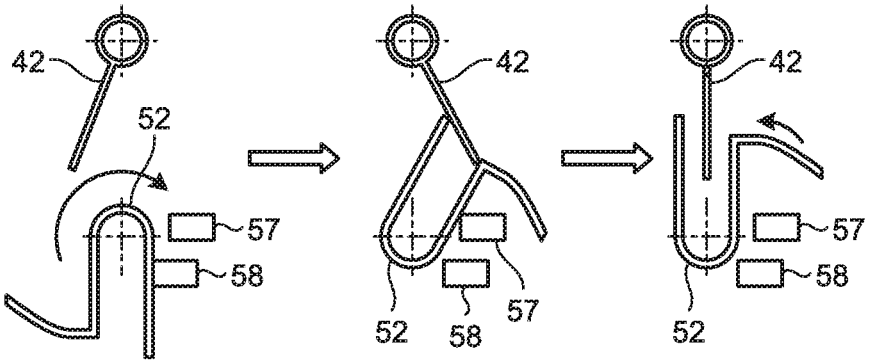
FIG. 14 is a state transition diagram for explaining an operation of positioning the flap at an initial position.

FIG. 14 is a state transition diagram for explaining an operation of positioning the flap 42 at the initial position. The control unit 76 controls the motor 45 after all of the mediums are ejected through the paper ejection slot 8, to rotate the driving axis 44 in the reverse direction sufficiently until the set guide 52 is positioned at the reverse-rotation stopper-abutting position. The set guide 52 abuts on the reverse rotation stopper 57 when positioned at the reverse-rotation stopper-abutting position, and is thus restricted reverse rotation, to be kept at the reverse-rotation stopper-abutting position. The flap 42 is released to be positioned in the retraction area when the set guide 52 is positioned in the release area. The flap 42 is held by the set guide 52 when the set guide 52 is positioned in the hold area. The control unit 76 controls the motor 45 after the set guide 52 is positioned at the reverse-rotation stopper-abutting position, to rotate the driving axis 44 in the forward direction as much as a predetermined number of steps. The set guide 52 rotates in the forward direction when the driving axis 44 rotates in the forward direction as much as the predetermined number of steps, and is thereby positioned at the set-guide initial position. The flap 42 is positioned at the flap initial position when the set guide 52 is positioned at the set-guide initial position.

The image reading apparatus 10 can bring edges of mediums into contact with the flap 42 appropriately if the mediums are set on the hopper 14 while the flap 42 is positioned at the flap initial position. By the arrangement that the flap 42 is automatically positioned at the flap initial position after the operation of reading images on the mediums is performed, a user is allowed to set other mediums on the hopper 14 right after the operation of reading images on the mediums is performed. By allowing other mediums to be set on the hopper 14 right after the operation of reading images on mediums is performed, the image reading apparatus 10 can perform the operation of aligning edges of the other mediums and the operation of reading images on the other mediums swiftly.

Figure 15:
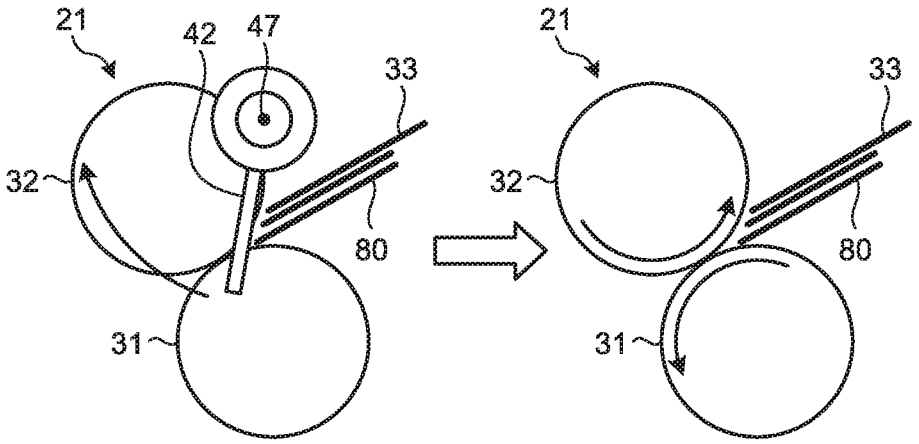
FIG. 15 is a state transition diagram for explaining an action of the flap moving from a contact area to a release area.

FIG. 15 is a state transition diagram for explaining an action of the flap 42 moving from the contact area to the release area. The flap 42 rotates (clockwise direction in FIG. 15) about the rotation axis 47 by being pushed by the mediums 33 that are inserted to the medium-separation transfer path 16 from the separation slot 7 when the set guide 52 is positioned in the release area, and moves from the contact area to the release area. At this time, a medium 80 that is in contact with the setting plate 15 of the hopper 14 out of the mediums 33 comes into contact with the pick roller 31 prior to the other mediums out of the mediums by the flap 42 rotating about the rotation axis 47. Because the medium 80 comes into contact with the pick roller 31 prior to the other mediums, the separating unit 21 can separate the medium 80 from the mediums 33 appropriately, and can transfer the medium 80 to the merging point 12.

Figure 16:
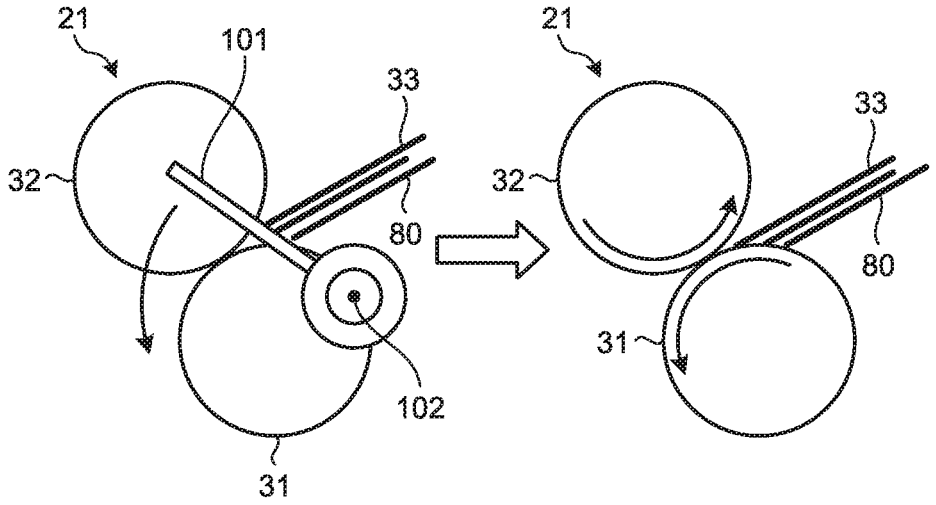
FIG. 16 is a state transition diagram for explaining an action of a flap of a medium transfer device of a comparative example moving from a contact area to a release area.

In a medium transfer device of a comparative example, the flap 42 of the medium transfer device according to the first embodiment described is replaced with a flap 101 as illustrated in FIG. 16. FIG. 16 is a state transition diagram for explaining an action of the flap 101 of the medium transfer device of the comparative example moving from the contact area to the release area. The flap 101 is supported rotatably about a rotation axis 102. The flap 101 rotates (counterclockwise direction in FIG. 15) about the rotation axis 102 when pushed by the mediums 33 that are inserted to the medium-separation transfer path 16 from the separation slot 7, and thereby being retracted from the mediums 33. At this time, the medium 80 can come into contact with the pick roller 31 later than mediums other than the medium 80 out of the mediums 33 by the flap 101 rotating about the rotation axis 102. When the medium 80 comes into contact with the pick roller 31 later than the other mediums, the separating unit 21 cannot separate the medium 80 from the mediums 33 appropriately in some cases. The medium transfer device 1 according to the first embodiment can separate the medium 80 from the mediums 33 appropriately compared to the medium transfer device of the comparative example.

Effects of Medium Transfer Device of First Embodiment

The medium transfer device 1 according to the first embodiment includes the flap 42, the hopper 14, and the flap driving unit 43. In the hopper 14, the setting plate 15 on which the mediums 33 are placed is formed such that the mediums 33 are moved toward the flap 42 by gravitation. The flap driving unit 43 swings the flap 42 such that the mediums 33 are shaken by the flap 42.

The medium transfer device 1 can align edges of the mediums 33 appropriately by swinging the flap 42 to shake the mediums 33. The medium transfer device 1 can separate one of the mediums 33 from the mediums 33 appropriately by aligning the edges of the mediums appropriately. Furthermore, the medium transfer device 1 align edges of the mediums 33 automatically, thereby eliminating the necessity for a user to align the edges of the mediums 33 and making a work of setting the mediums 33 on the hopper 14 easy for the user.

Moreover, the medium transfer device 1 according to the first embodiment further includes the separating unit 21 that separates the one medium 80 from the mediums 33. The flap 42 is supported rotatably about the rotation axis 47 so as to be positioned in the contact area or the retraction area. The flap 42 is in contact with the mediums 33 when the flap 42 is positioned in the contact area so that the mediums are not separated by the separating unit 21. The flap 42 is apart from the medium 80 when the flap 42 is positioned in the retraction area so that the medium 80 is separated from the mediums 33 by the separating unit 21. The rotation axis 47 is positioned such that mediums other than the medium 80 out of the mediums 33 are positioned between the rotation axis 47 and the medium 80.

In the medium transfer device 1, the medium 80 is provided to the separating unit 21 prior to the others out of the mediums 33 when the flap 42 moves from the contact area to the retraction area. Because the medium 80 is provided to the separating unit 21 prior to the other mediums out of the mediums 33, the separating unit 21 can separate the medium 80 from the mediums 33 appropriately, and transfer the medium 80 appropriately.

Furthermore, the flap driving unit 43 of the medium transfer device 1 according to the first embodiment includes the set guide 52 that is movably supported so as to be positioned in the release area or the hold area, and the set-guide driving unit 53 that moves the set guide 52 to swing the flap 42. When the set guide 52 is positioned in the release area, the flap 42 is released from the set guide 52, and thereby positioned in the retraction area. When the set guide 52 is positioned in the hold area, the flap 42 is held by the set guide 52 and is positioned in the contact area. The medium transfer device 1 moves the flap 42 by using the set guide 52, and thereby separates the set-guide driving unit 53 and the flap 42 by the medium-separation transfer path 16.

Moreover, the separating unit 21 of the medium transfer device 1 according to the first embodiment includes the pick roller 31 and the brake roller 32. The pick roller 31 rotates, and thereby transfers the medium 80. To avoid mediums other than the medium 80 out of the mediums 33 from being transferred when the medium 80 is transferred by the pick roller 31, the brake roller 32 comes in contact with the other mediums. In the set guide 52, the curved-out portion is formed. The curved-out portion 56 comes in contact with the medium 80 to prevent contact of the medium 80 with the pick roller 31 when the set guide 52 is positioned in the hold area. The curved-out portion 56 is separated from the medium 80 such that the medium 80 comes in contact with the pick roller 31 when the set guide 52 is positioned in the release area. With the curved-out portion 56 provided therein, the medium transfer device 1 can prevent contact of the mediums with the pick roller 31 while the mediums 33 are shaken by the flap 42, and can align edges of the mediums appropriately.

Furthermore, the medium transfer device 1 according to the first embodiment further includes the empty sensor 71 and the control unit 76. The empty sensor 71 detects whether a medium is set on the hopper 14. When it is detected that a medium is not set on the hopper 14, the control unit 76 controls the flap driving unit 43 to position the flap 42 in the contact area. By automatically positioning the flap 42 in the contact area when a medium is not set on the hopper 14, the medium transfer device 1 eliminates the necessity to operate the medium transfer device 1 for a user to position the flap 42 in the contact area, thereby simplifying the operation for the user.

Moreover, the medium transfer device 1 according to the first embodiment further includes the motor 45 that drives the separating unit 21. The flap driving unit 43 swings the flap 42 by using a rotating power generated by the motor 45. The medium transfer device 1 can move the set guide 52 by using the motor 45 that drives the separating unit 21, and can swing the flap 42 by using the motor 45.

Furthermore, the medium transfer device 1 according to the first embodiment further includes the hopper driving unit 72 that moves the hopper 14 and the control unit 76 that controls the hopper driving unit 72 such that the inclination of the setting plate 15 is steep when the mediums 33 are set on the hopper 14. The medium transfer device 1 can bring the mediums 33 set on the hopper 14 close to the flap 42 further surely by moving the hopper 14 such that the inclination of the setting plate 15 is steep, and thereby can bring the mediums 33 into contact with the flap 42 further surely.

Moreover, the medium transfer device 1 according to the first embodiment further includes the hopper driving unit that moves the hopper 14 and the control unit 76 that controls the hopper driving unit 72 to shake the hopper 14 when the mediums 33 are set on the hopper 14. By shaking the hopper 14, the medium transfer device 1 can shake the mediums 33 set on the hopper 14 further surely, and thereby can align edges of the mediums appropriately.

Furthermore, the medium transfer device 1 according to the first embodiment further includes the protrusion 34, the protrusion driving unit 73, and the control unit 76. The protrusion 34 comes in contact with a surface of the mediums 33 facing the setting plate 15. The protrusion driving unit 73 moves the protrusion 34. The control unit 76 controls the protrusion driving unit 73 to shake the protrusion 34 when the mediums 33 are set on the hopper 14. By shaking the protrusion 34, the medium transfer device 1 can shake the mediums set on the hopper 14 further surely, and thereby can align edges of the mediums 33 appropriately.

Moreover, the medium transfer device 1 according to the first embodiment further includes the left side guide 36, the right side guide 37, the side-guide driving unit 74, and the control unit 76. The left side guide 36 and the right side guide 37 restrict movement of the mediums 33 not to be moved toward directions other than the direction in which the mediums 33 are moved by gravitation. The side-guide driving unit 74 moves the left side guide 36 and the right side guide 37. The control unit 76 controls the side-guide driving unit 74 to shake the left side guide 36 and the right side guide 37 when the mediums 33 are set on the hopper 14. The medium transfer device 1 according to the first embodiment can shake the mediums set on the hopper 14 further surely by shaking the left side guide 36 and the right side guide 37, and thereby can align edges of the mediums 33 appropriately.

Furthermore, in the left side guide 36 of the medium transfer device 1 according to the first embodiment, the left side-guide ribs 40 that enter gaps between the mediums 33 are formed. By arranging the left side-guide ribs 40, the left side-guide ribs 40 enter gaps between the mediums 33 while the mediums 33 are shaken, to facilitate entrance of air into the gaps between the mediums 33 in the medium transfer device 1. The medium transfer device 1 can reduce the frictional forces among the mediums 33 by air entering gaps between the mediums 33, and can align edges of the mediums 33 appropriately.

Moreover, the setting plate 15 of the medium transfer device 1 according to the first embodiment is bent such that edges of the mediums 33 in contact with the flap 42 are warped. The edges of the medium 33 that come in contact with the flap 42 increase in strength by being warped, and it prevents ends of the mediums 33 from being folded. The medium transfer device 1 can align edges of the mediums 33 appropriately because ends of the mediums 33 are prevented from being folded, and thereby can transfer the mediums 33 one by one appropriately.

Furthermore, in the flap 42 of the medium transfer device 1 according to the first embodiment, the projections and depressions 62 that enter gaps between the mediums 33 are formed. By arranging the projections and depressions 62, the projections and depressions 62 enter gaps between the mediums while the mediums 33 are shaken, thereby facilitating entrance of air into the gaps between the mediums 33 in the medium transfer device 1. Because the frictional forces among the mediums 33 is reduced by air entering the gaps between the mediums 33, the medium transfer device 1 can align edges of the mediums 33 appropriately.

Moreover, in the hopper 14 of the medium transfer device 1 according to the first embodiment, the stopper 35 to be opposed to an end of the mediums 33 on the opposite side of one end opposing to the flap 42 is formed. By arranging the stopper 35, rear ends of the mediums 33 come into contact with the stopper 35 when the mediums 33 are shaken by the flap 42, and the medium transfer device 1 can align the mediums more appropriately.

Furthermore, the medium transfer device 1 according to the first embodiment further includes the air blowing unit 75 that blows air on edges of the mediums 33. By blowing air on edges of the mediums 33, the medium transfer device 1 lets air enter gaps between the mediums 33 to reduce the frictional forces among the mediums 33, and thereby can align the edges of the mediums 33 appropriately.

Second Embodiment

Figure 17:
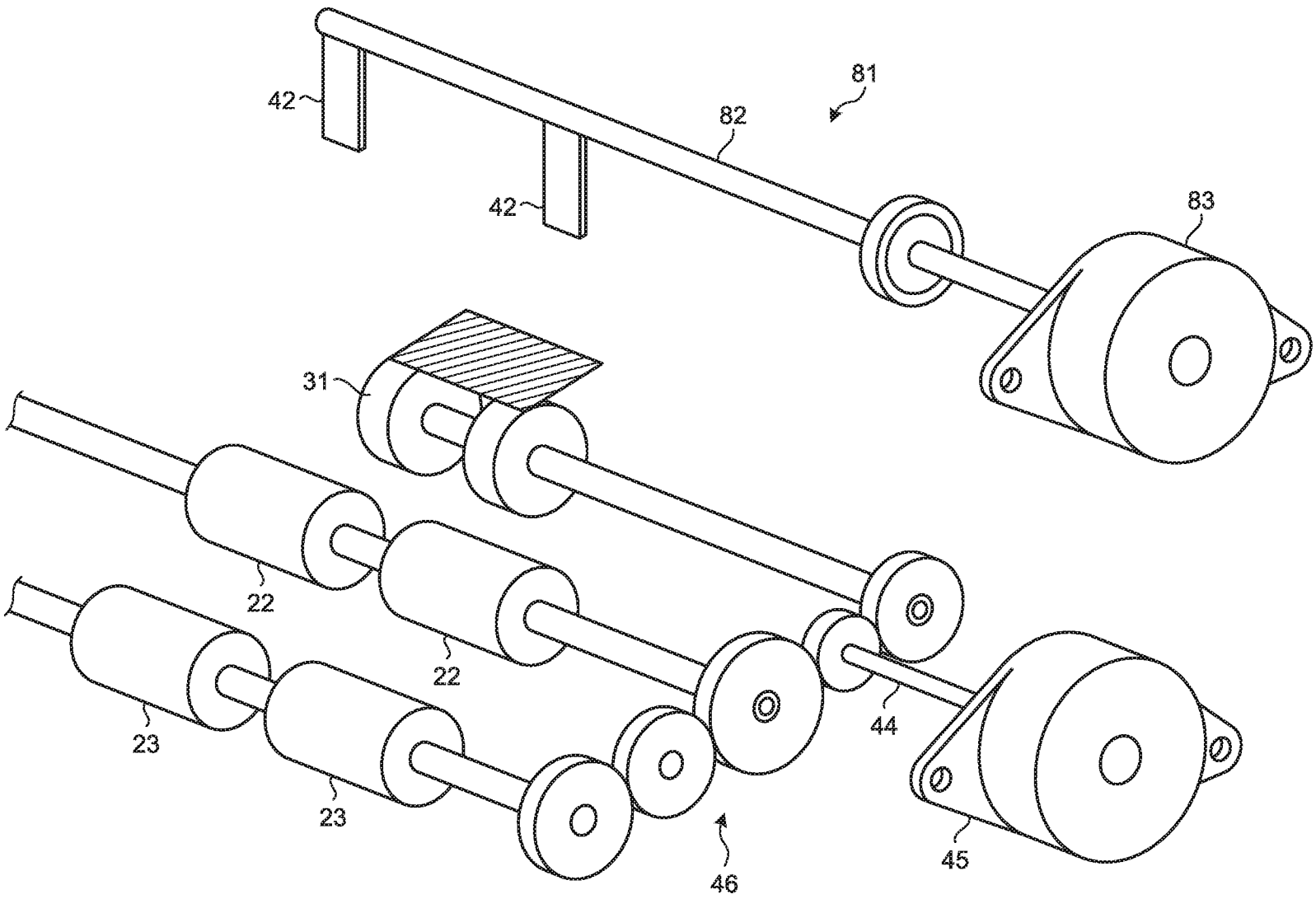
FIG. 17 is an exploded perspective view of a transfer unit of a medium transfer device according to a second embodiment.

In a medium transfer device according to a second embodiment, the flap driving unit 43 of the medium transfer device 1 according to the first embodiment described above is replaced with another flap driving unit 81 as illustrated in FIG. 17. FIG. 17 is an exploded perspective view of a transfer unit of the medium transfer device according to the second embodiment. The flap driving unit 81 includes a flap driving axis 82 and a motor 83. The flap driving axis 82 is fixed to the flap 42, and is rotatably supported by the upper frame 3. The motor 83 causes the flap driving axis 82 to rotate in a forward direction or in a reverse direction, being controlled by the control unit 76. That is, the control unit 76 controls the motor 83 to swing the flap 42 in the contact area.

The transfer medium according to the second embodiment can swing the flap 42 appropriately in the contact area and align edges of the mediums appropriately similarly to the medium transfer device 1 according to the first embodiment, even when the motor 83 different from the motor is used. Because the motor 83 is not provided in the medium transfer device 1 according to the first embodiment, the number of parts is reduced from that of the medium transfer device according to the second embodiment, and the manufacturing cost can be reduced.

Third Embodiment

Figure 18:
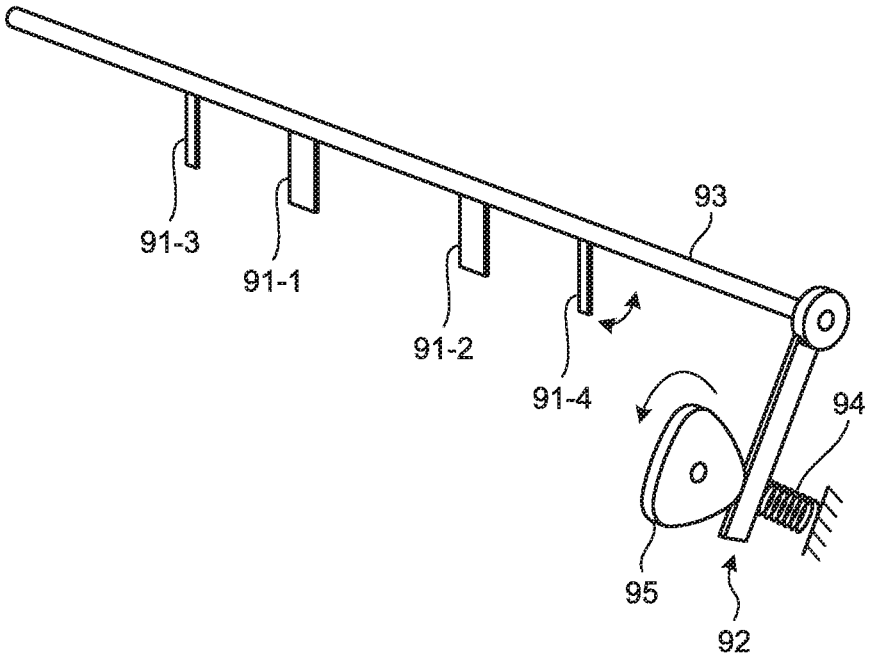
FIG. 18 is a perspective view of four flaps and a flap driving unit of a medium transfer device according to a third embodiment.

In a medium transfer device according to a third embodiment, the flap 42 in the medium transfer device 1 described above is replaced with other four flaps 91-1 to 91-4, and the flap driving unit 43 is replaced with another flap driving unit 92 as illustrated in FIG. 18. FIG. 18 is a perspective view of the four flaps 91-1 to 91-4 and the flap driving unit 92 of the medium transfer device according to the third embodiment. The flap driving unit 92 includes a flap driving axis 93, a compression coil spring 94 and a plate cam 95. The flap driving axis 93 is fixed to the four flaps 91-1 to 91-4, and is rotatably supported by the upper frame 3. The compression coil spring 94 applies an elastic force to a part of the flap driving axis 93 so that the flap driving axis 93 rotates. The plate cam 95 is rotatably supported by the upper frame 3. A periphery of the plate cam 95 does not match with a circle about a rotation axis of the plate cam 95 and, therefore, a distance between the periphery of the plate cam 95 and the rotation axis vary depending on a position on the periphery. The plate cam 95 is in contact with a part of the flap driving axis 93 at its periphery to oppose the elastic force of the compression coil spring 94. Therefore, the four flaps 91-1 to 91-4 swing as the plate cam 95 rotate in one direction.

The rotation transfer mechanism 46 transfers rotation of the driving axis 44 to the plate cam 95. For example, the rotation transfer mechanism 46 rotates the plate cam 95 when the driving axis 44 rotates in a reverse direction. Therefore, the medium transfer device according to the third embodiment can swing the four flaps 91-1 to 91-4 by rotating the driving axis 44 in one direction, for example, rotating in the reverse direction. Therefore, the medium transfer device according to the third embodiment can perform control of the motor 45 to swing the four flaps 91-1 to 91-4 easily compared to the medium transfer device 1 according to the first embodiment described above.

Figure 19:
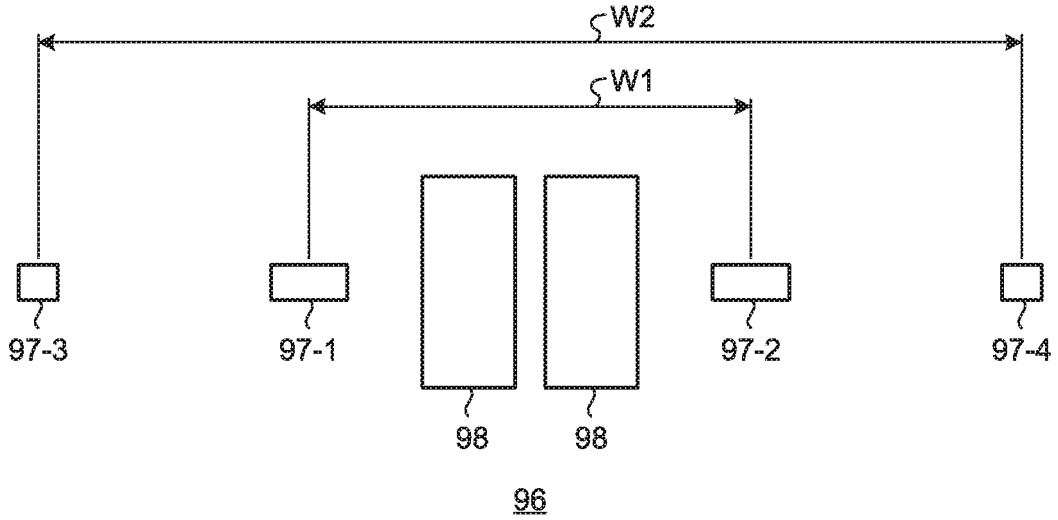
FIG. 19 is a plan view of a medium-separation transfer-path guide that forms an upper part of a medium-separation transfer path of the medium transfer device according to the third embodiment.

FIG. 19 is a plan view of a medium-separation transfer-path guide 96 that forms an upper part of the medium-separation transfer path 16 of the medium transfer device according to the third embodiment. The medium-separation transfer-path guide 96 is formed in a plate shape, and has flap through holes 97-1 to 97-4 and brake-roller through holes 98 formed therein as illustrated in FIG. 19. The medium-separation transfer-path guide 96 is arranged between the rotation axis of the flap driving axis 93 and the medium-separation transfer path 16, between the rotation axis of the brake roller 32 and the medium-separation transfer path 16, and above the medium-separation transfer path 16. Into the four flap through holes 97-1 to 97-4, the four flaps 91-1 to 91-4 pierce through. Into the brake-roller through hole 98, the brake roller 32 pierces through.

The brake-roller through hole 98 is formed between a first flap through hole 97-1 and a second flap through hole 97-2 out of the four flap through holes 97-1 to 97-4. The first flap through hole 97-1 and the second flap through hole 97-2 are formed between a third flap through hole 97-3 and a fourth flap through hole 97-4 out of the four flap through holes 97-1 to 97-4. A distance W1 between the first flap through hole 97-1 and the second flap through hole 97-2 is smaller than the smallest width of a medium in a size transferable by the medium transfer device according to the third embodiment. A distance W2 between the third flap through hole 97-3 and the fourth flap through hole 97-4 is larger than the smallest width of a medium in a size transferable by the medium transfer device according to the third embodiment.

The medium transfer device according to the third embodiment can align edges of mediums in any size transferable by the medium transfer device according to the third embodiment by arranging the four flaps 91-1 to 91-4. A medium transfer device of a comparative example having more than four flaps needs more than four flap through holes to be formed in the medium-separation transfer-path guide 96. The mediums transfer device according to the third embodiment has large strength in the medium-separation transfer-path guide compared to the medium transfer device of such a comparative example, and is preferable.

A disclosed medium transfer device is capable of transferring mediums appropriately one by one.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium transfer device comprising:

a swinging member;

a hopper in which a setting plate on which a plurality of mediums are placed such that the mediums are moved toward the swinging member by gravitation; and a driving unit configured to swing the swinging member when the mediums abut on the swinging member such that the mediums are shaken by the swinging member.

2. The medium transfer device according to claim 1, further comprising a separating unit configured to separate one medium from the mediums, wherein the swinging member is supported rotatably about a rotation axis to be positioned in any one of a contact area and a retraction area, comes into contact with the mediums to prevent the mediums from coming into contact with the separating unit when positioned in the contact area so that the mediums are not separated by the separating unit, and is separated from the one medium to move the one medium toward the separating unit when positioned in the retraction area so that the one medium is separated from the mediums by the separating unit, and the rotation axis is arranged such that mediums other than the one medium out of the mediums are positioned between the rotation axis and the one medium.

3. The medium transfer device according to claim 2, wherein the driving unit includes a set guide that is movably supported to be positioned in any one of a release area and a hold area; and a set-guide driving unit that moves the set guide to swing the swinging member, wherein when the set guide is positioned in the release area, the swinging member is released from the set guide and is thereby positioned in the retraction area, and when the set guide is positioned in the hold area, the swinging member is held by the set guide and is thereby positioned in the contact area.

4. The medium transfer device according to claim 3, wherein the separating unit includes a pick roller that transfers the one medium by rotating; and a brake roller that comes into contact with other mediums other than the one medium out of the mediums such that the other mediums are not transferred when the one medium is transferred by the pick roller, the set guide includes a curved-out portion, and the curved-out portion comes in contact with the one medium to avoid the one medium from being contact with the pick roller when the set guide is positioned in the hold area, and is separated from the one medium so that the one medium is in contact with the pick roller when the set guide is positioned in the release area.

5. The medium transfer device according to claim 2, further comprising:

a sensor that detects whether a medium is set on the hopper; and a controller configured to control the driving unit such that the swinging member is positioned in the contact area when it is detected that a medium is not set on the hopper.

6. The medium transfer device according to claim 2, further comprising a motor that drives the separating unit, wherein the driving unit moves the swinging member toward the retraction area by using a rotating power generated by the motor when the motor drives the separating unit so that the separating unit separates the mediums, moves the swinging member toward the contact area by using the rotating power when the motor drives the separating unit so that the separating unit does not separates the mediums, and swings the swinging member by using the rotating power when the swinging member is positioned in the contact area.

7. The medium transfer device according to claim 1, further comprising:

a hopper driving unit that moves the hopper; and a controller configured to control the hopper driving unit such that inclination of the setting plate is steep when the mediums are set on the hopper.

8. The medium transfer device according to claim 1, further comprising:

a hopper driving unit that moves the hopper; and a controller configured to control the hopper driving unit to swing the hopper when the mediums are set on the hopper.

9. The medium transfer device according to claim 1, further comprising:

a protrusion that comes in contact with a surface of the mediums facing the setting plate;

a protrusion driving unit that moves the protrusion; and a controller configured to control the protrusion driving unit to shake the protrusion when the mediums are set on the hopper.

10. The medium transfer device according to claim 1, further comprising:

a side guide that controls movement of the mediums not to be move toward directions other than a direction in which the mediums are moved by gravitation;

a side-guide driving unit that moves the side guide; and a controller configured to control the side-guide driving unit to shake the side guide when the mediums are set on the hopper.

11. The medium transfer device according to claim 10, wherein the side guide has a plurality of ribs that enter gaps between the mediums.

12. The medium transfer device according to claim 1, wherein the setting plate is bent.

13. The medium transfer device according to claim 1, wherein the swinging member has projections that enter gaps between the mediums.

14. The medium transfer device according to claim 1, wherein the hopper has a stopper that opposes an end of the mediums on an opposite side of an end opposing to the swinging member.

15. The medium transfer device according to claim 1, further comprising a blowing unit that blows air on edges of the mediums.

* * * * *